United States Patent [19]

Bein

[11] Patent Number: 4,690,206

[45] Date of Patent: Sep. 1, 1987

[54] NUCLEAR STEAM GENERATOR WRAPPER BARREL/TUBE SUPPORT PLATE CONNECTION ASSEMBLY AND RADIAL TUNING METHOD FOR ASSEMBLING SAME

[75] Inventor: Jeffrey D. Bein, Pleasant Hills, Pa.

[73] Assignee: Westinghouse Electric Corp., Pittsburgh, Pa.

[21] Appl. No.: 757,719

[22] Filed: Jul. 22, 1985

[51] Int. Cl.[4] ..... F28F 7/00

[52] U.S. Cl. ..... 165/81; 29/157.4; 122/512; 165/76; 165/162; 376/285

[58] Field of Search ..... 165/81, 76, 162; 29/157.4, 157.3; 122/510, 511, 512; 376/285

[56] References Cited

U.S. PATENT DOCUMENTS

| | | | |
|---|---|---|---|
| 3,182,003 | 5/1965 | Thorp, II et al. | 176/78 |
| 3,215,608 | 11/1965 | Guenther | 165/81 X |
| 3,247,897 | 4/1966 | Ammon | 165/81 |
| 3,661,708 | 5/1972 | Friedland | 176/28 |
| 3,719,560 | 3/1973 | Mayers et al. | 176/78 |
| 4,076,586 | 2/1978 | Bideau et al. | 176/78 |
| 4,204,305 | 5/1980 | Norton | 29/157.4 |
| 4,267,020 | 5/1981 | Burack | 176/87 |
| 4,281,941 | 8/1981 | Rottenkolber | 403/29 |
| 4,415,021 | 11/1983 | Bayless et al. | 165/76 |
| 4,421,714 | 12/1983 | Dronkers | 376/204 |
| 4,505,329 | 3/1985 | Nguyen-Thanh | 165/81 |

FOREIGN PATENT DOCUMENTS 2104205A 3/1983 United Kingdom .

OTHER PUBLICATIONS

U.K. Search Report for Application No. 8617809, dated 9/12/86.

*Primary Examiner*—Edward G. Favors

[57] ABSTRACT

A steam generator wrapper barrel/tube support plate connection assembly and method for assembling same which prevents interference due to thermal interaction between a wrapper barrel with a first coefficient to thermal expansion and a tube support plate with a second, relatively higher coefficient of thermal expansion. Interference is prevented by radially tuning the wrapper barrel, i.e., locally introducing preload via increased stud thread engagement in the jacking assembly to deform the wrapper barrel during assembly. During subsequent heat-up and operation the preload is relieved through outer shell expansion. In addition, heat and/or pressure dissolvable-surfaced or spring-surfaced shims or wedges are fit between the wrapper barrel and the tube support plate to further compensate for tube support plate thermal expansion.

24 Claims, 12 Drawing Figures

NUCLEAR STEAM GENERATOR WRAPPER BARREL/TUBE SUPPORT PLATE CONNECTION ASSEMBLY AND RADIAL TUNING METHOD FOR ASSEMBLING SAME

BACKGROUND OF THE INVENTION

This invention relates to nuclear steam generators and, more particularly, to a connection assembly and a method related thereto for eliminating or selectively minimizing the structural interference caused by thermal expansion during operation of a nuclear steam generator between a wrapper barrel made of a material having a particular coefficient of thermal expansion and a tube support plate system whose constituent plates have a relatively higher coefficient of thermal expansion.

DESCRIPTION OF THE PRIOR ART

A typical nuclear steam generator of the type generally referred to herein is described in commonly owned U.S. Pat. No. 4,303,043, issued to MALICK, and is shown in FIG. 1 herein. Such a nuclear steam generator, which is referred to generally by reference numeral 20, comprises a vertical, outer shell 22 with a primary fluid inlet nozzle 24 and a primary fluid outlet nozzle 26, which are attached near the lower end. A vertical, inner shell or wrapper barrel 23, has at its lower end a tubesheet 28, having tube holes 30 formed therein. Tubes 38, which are heat transfer tubes shaped with a U-like curvature, are disposed within the wrapper barrel 23 and are attached to the tubesheet 28 by the tube holes 30. The tubes 38, which may number about 7,000, form collectively what is known as a tube bundle 40. In addition, a plurality of tube support plates 33 are horizontally located in and connected to the wrapper barrel 23 for receiving, aligning and providing support to the tubes 38. A dividing plate 32, which is attached to both the tubesheet 28 and the outer shell 22, defines a primary fluid inlet plenum 34 and a primary fluid outlet plenum 36. Further, a secondary fluid inlet nozzle 42 is disposed on the outer shell 22, while a steam outlet nozzle 44 is attached to the top of the outer shell 22. Finally, manways 46 are provided through the outer shell 22 to provide access to both the primary fluid inlet plenum 34 and the primary fluid outlet plenum 36, so that access may be had to the entire tubesheet 28.

In operation, primary fluid enters the primary fluid inlet nozzle 24, flows into the primary fluid inlet plenum 34, through the tubes 38, into the primary fluid outlet plenum 36 and exits through the primary fluid outlet nozzle 26. While flowing through the tubes 38, heat is transferred from the primary fluid to a secondary fluid circulating through the tube support plates 33 and around tubes 38, causing the secondary fluid to vaporize and exit through the steam outlet nozzle 44.

When designing nuclear steam generators such as the one described above, environmental and load conditions must be carefully accommodated. With regard to environmental conditions, conventional nuclear steam generator materials are subject to varying amounts of corrosion, depending upon the type of metals used therein. With regard to load conditions, nuclear steam generators must be designed to sustain conservative estimates of static and dynamic loadings, such as earthquakes or hydraulic accident events, and to maintain the integrity of the primary pressure boundary or tube bundle.

Consideration of these environmental and load conditions is particularly important in regard to the tube support plates 33 because they are responsible for aligning the tube bundle 40, maintaining the span lengths or spacings between adjacent tube support plates, providing each tube 38 with adequate restraint at each tube 38/tube support plate 33 intersection, minimizing tube 38 vibration, sustaining static and dynamic loadings, and maintaining the overall integrity of the tube bundle 40 for the useful life of the steam generator.

Since each tube 38 is inserted into each tube support plate 33, there is a large number of tube 38/tube support plate 33 intersections. In addition, there is a plurality of connections between each tube support plate 33 and the wrapper barrel 23, each of which will be termed herein a wrapper barrel/tube support plate connection assembly. Water and contaminants, in addition to chemical reaction (tube support plate 33 material and tube 38 material) by-products, tend to concentrate at these intersections and connections, which in turn tends to accelerate corrosion of the tubes 38 and the tube support plates 33. Further, the contaminants ultimately may physically damage the primary pressure boundary and/or the tube bundle 40, by locally compressing or locally yielding and "denting" the tubes 38, if the contaminant concentration in the confined intersection is high enough.

Clearly then, a tube support plate 33 made of a metal with improved corrosion resistance and having the required mechanical/structural properties is desired if the probability of damage to the tube support plate 33 is to be reduced.

Development work is currently being conducted with new stainless steels for making tube support plates 33. These new stainless steels contain higher amounts of chromium and nickel than traditionally employed stainless steels in order to combat the possibility of the corrosion discussed above. However, these new stainless steels also have correspondingly higher coefficients of thermal expansion than the materials traditionally employed to produce the structures of the tube support plates 33.

For example, two of the principal materials for producing tube support plates 33 currently being tested are the Incoloy 800 Class and Class 347 of stainless steels. Both have been shown in tests to have very good corrosion behavior, exclusive of electrochemical/galvanic effects. However, the ratios of the mean coefficients of thermal expansion of a tube support plate made of Incoloy 800 Class or Class 347 relative to the wrapper barrel 23 at service conditions are 1.2 and 1.3, respectively. By way of comparison, the ratios of the mean coefficients of thermal expansion of the conventional tube support plate 33 materials suggested above, e.g., carbon steel and Class 405 stainless steel, to the wrapper barrel 23 are 1.0 and 6.88, respectively.

Clearly, use of these new materials, e.g., Incoloy 800 Class and Class 347, will result in thermal interference between the tube support plate 33 and the wrapper barrel 23 upon thermal expansion (ratio $>1$), whereas using the conventional materials (carbon steel, Class 405) will result in little or no interference (ratio $<1$). Thus, the use of these new materials in tube support plates 33 gives rise to greater anti-corrosion characteristics, but also gives rise to additional structural considerations at the wrapper barrel/tube support plate connection assemblies due to relative thermal expansion of these adjacent components and, hence, due to the resulting thermal interactions.

FIG. 2 illustrates a conventional "locked" wrapper barrel/tube support plate connection assembly, referred to by reference numeral 50, as it appears once assembled, but before operation of the steam generator. This assembly 50 is designed without regard for the coefficient of thermal expansion of the material making up the tube support plate 33 or without regard for the coefficient of thermal expansion of the material making up the wrapper barrel 23.

More particularly, the wrapper barrel 23 is positioned between the outer shell 22 and each tube support plate 33 holding the tubes 38. A jacking assembly 52, usually made of carbon steel and welded to the wrapper barrel 23, projects through a cut-out in the wrapper barrel 23 and fits into an annular space 66 between the wrapper barrel 23 and the outer shell 22. The jacking assembly 52 includes: a jacking block 54 attached to the wrapper barrel 23 by seal welds 56 and fillets 58; and one or two threaded jacking studs 60 and 62 which extend a predetermined distance from the jacking block 54 to the outer shell. 22. A plurality of these jacking assemblies 52 are circumferentially located at each tube support plate 33 elevation. Further, a plurality of solid carbon steel wedges 64 is located in an annular space 67 formed between the wrapper barrel 23 and the tube support plate 33 and fixed during assembly via fillet welds 65 (FIGS. 2(*a*) and 2(*b*)). The wedges 64 are adjusted to "lock" the tube support plates 33 in place during assembly at each corresponding elevation of each tube support plate 33 and before operation of the steam generator. An example of the use of these wedges 64 is described in commonly owned U.S. Pat. No. 4,267,020, issued to BURACK.

At the beginning of operation of a steam generator using this conventional assembly 50, relative thermal expansion and pressure dilation between the outer shell 22 and the wrapper barrel 23 results in a gap 63 being formed between the jacking assembly 52 and the outer shell 22, as shown in FIG. 2(*a*). In addition, relative thermal expansion between the wrapper barrel 23 and the tube support plate 33 results in a gap 67' being formed between the tube support plate 33 and the wedges 64 connected to the outwardly expanding wrapper barrel 23 by fillet welds 65.

Subsequently, at the full load temperature and pressure operating conditions, if the coefficient of thermal expansion of the tube support plate 33 matches that of, or is less than that of, the wrapper barrel 23, no significant thermal interference is ultimately anticipated.

If, on the other hand, the coefficient of thermal expansion of the tube support plate 33 greatly exceeds that of the wrapper barrel 23, then thermal interference will occur between the tube support plate 33 and the wrapper barrel 23. This interference undesirably results in increased or non-permissible structural interactions and consequent deflections with associated high stresses upon both the tube support plate 33 and the wrapper barrel 23 during operation.

Practically speaking, during nuclear heat up and/or cycling to and from full power operation, the round periphery of the perforated, expanding tube support plate 33 has the potential of crashing or knocking into the wrapper barrel 23, as shown in FIG. 2(*b*). As a result, the jacking studs 60, 62 may be forced against the outer shell 22, and the wrapper barrel 23 may severly deflect locally, ultimately fatigue or even break at the jacking assembly 52 connections thereto, obviously causing a dangerous operating condition.

In addition, this locked assembly 50 is simply not adaptive enough to compensate satisfactorily for combined unexpected stresses upon the steam generator, e.g., thermal transient excursions plus earthquakes or hydraulic accident events.

Accordingly, a great need exists for a wrapper barrel/tube support plate connection assembly capable of compensating for a tube support plate 33 having a higher coefficient of thermal expansion than the wrapper barrel 23. The present invention satisfies this need and thus permits manufacture of nuclear steam generators in the classical structural configurations, but with desirable "advanced" corrosion resistant tube support plate materials. This will now be described.

SUMMARY OF THE INVENTION

Accordingly, it is an object of the present invention to provide a wrapper barrel/tube support plate connection assembly, including a wrapper barrel with a first coefficient of thermal expansion, a plurality of tube support plates with a second, relatively higher coefficient of thermal expansion, and means located between the wrapper barrel and the plurality of tube support plates to compensate for thermal expansion of the plurality of tube support plates during heat-up, seismic and thermal transients and normal operation of the steam generator.

It is another object of the present invention to provide a wrapper barrel/tube support plate connection assembly, wherein the gap between each of the tube support plates and the wrapper barrel is filled during assembly with a spacer means whose surface includes a heat and/or pressure dissolvable, organic, high strength, polymer or a belleville spring washer, and which is capable of further compensating for the lateral loadings incurred during heat-up and operation of the steam generator.

It is another object of the present invention to provide a method for introducing a preload to elastically deform the wrapper barrel during assembly which effectively eliminates thermal interferences and reduces the dynamic loading of the tube support plates during heat-up and operation of the steam generator.

Finally, it is an object of the present invention to provide a method for installing the above-referenced spacer means between the wrapper barrel and the tube support plates to additionally compensate for the lateral loadings incurred during heat-up and operation of the steam generator.

To achieve the foregoing and other objects of the present invention and in accordance with the purposes of the invention, there is provided a wrapper barrel/-tube support plate connection assembly and a method for assembling same, wherein a locally controlled preload is introduced into the wrapper barrel during assembly thereof. The preload is introduced via increased stud thread engagement in the jacking assembly located between the wrapper barrel and the outer shell, thus causing a local deformation in the wrapper barrel at each jacking assembly location. This preload is ensured at the point of assembly by controlling stud torque and by discrete radial measurements at every opposing (180° circumferential orientation) jacking assembly location. The preload established at cold assembly conditions is based upon full power pressure and temperature operating requirements of a particular steam generator. Thus, preload can be basically site specific, i.e., tailored or tuned to a particular steam generator design or geometry (i.e., size and thermal or power performance requirements).

In addition, to further compensate for the amount of interference which could occur at operating temperatures, the gap remaining after preload (during manufacture) between each tube support plate and the wrapper barrel is fit with a spacer means including a heat and/or pressure dissolvable, organic, high strength, polymer surface or a belleville spring washer surface. This spacer means maintains a tight fit between each tube support plate and the wrapper barrel during assembly and compensates for the lateral loadings incurred during heat-up and operation of the steam generator. The dissolving of the spacer, as it deconstitutes during increasing pressure and temperature, is accompanied by the radial growth of the high thermal expansion tube support plate. This growth exceeds that of the wrapper barrel and thus, eliminates the gap originally occupied by the spacer and, furthermore, results in minimal interference or precludes interference entirely.

Accordingly, the present invention overcomes the disadvantages of the conventional, locked wrapper barrel/tube support plate connection assembly discussed above by eliminating any thermal interference caused by expansion of high coefficient of thermal expansion tube support plates and reduces overall the dynamic loadings of the tube support plates. In addition, the present invention reduces jacking stud head to outer shell gap, thus further lowering dynamic loading and mitigating increases in required tube support plate thickness which would be required to sustain the higher dynamic loadings. Finally, the present invention restores the gap between the tube support plate and the wrapper barrel, thus eliminating thermal expansion concerns at this location also.

BRIEF DESCRIPTION OF THE DRAWINGS

The accompanying drawings, which are incorporated in and constitute a part of the specification, illustrate embodiments of the invention and, together with the description serve to explain the principles of the invention.

FIG. 2(*a*) is a side, cross-sectional view of the conventional wrapper barrel/tube support plate connection assembly shown in FIG. 2 during full power operation of the steam generator.

FIG. 2(*b*) is a side, cross-sectional view of the conventional wrapper barrel/tube support plate connection assembly utilizing the conventional and/or advanced tube support plate materials as shown in FIG. 2 at full load temperature and pressure operating conditions.

DESCRIPTION OF THE PREFERRED EMBODIMENTS

Figure 1:
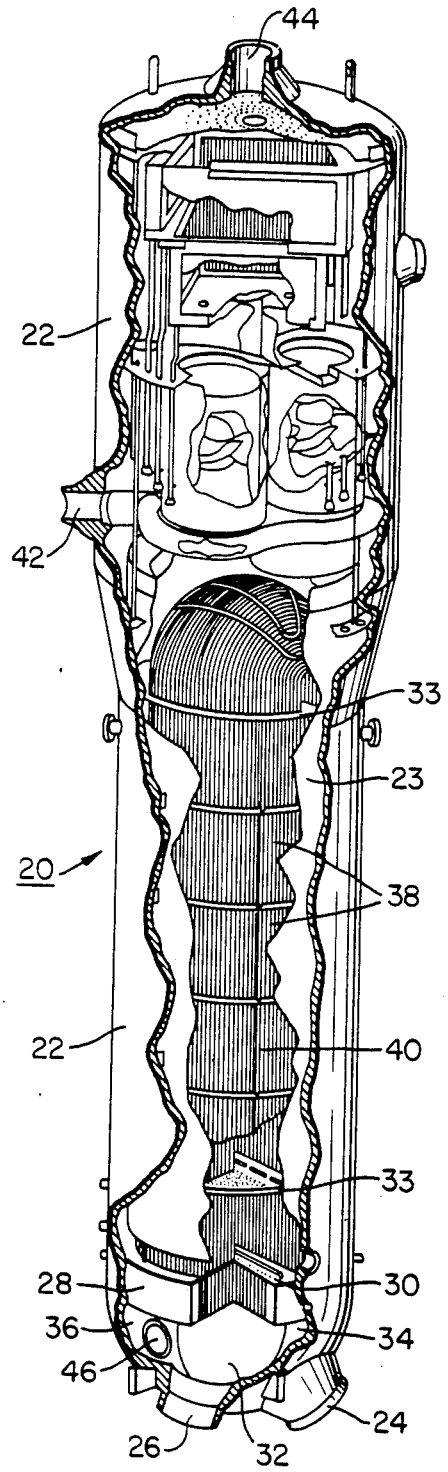
FIG. 1. PRIOR ART
FIG. 1 is an elevational, cross-sectional view of a conventional nuclear steam generator.
Figure 2:
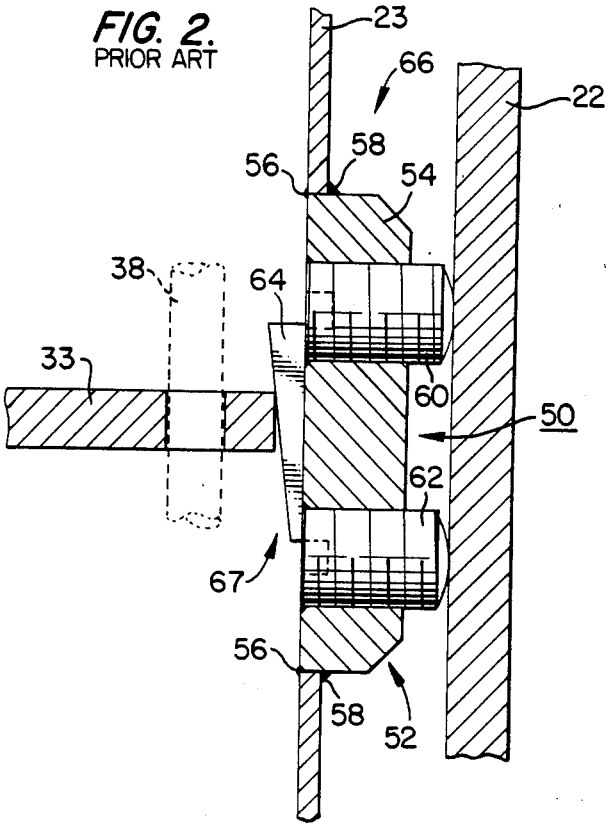
FIG. 2. PRIOR ART
FIG. 2 is a side, cross-sectional view of a conventional wrapper barrel/tube support plate connection assembly as it appears after assembly, but before operation of the steam generator.

In contrast to the conventional, locked, wrapper barrel/tube support plate connection assembly 50 shown in FIGS. 2, 2(*a*) and 2(*b*) and discussed above, FIGS. 3–10 illustrate the present invention's wrapper barrel/tube support connection assembly 70 and method for assembling same which generally introduces a locally controlled preload into a wrapper barrel 72 during assembly of the steam generator. Preload is defined as the amount of local load upon the support plate periphery and upon the internal diameter of the wrapper barrel resulting from the torque that must be applied to the jacking studs 80 to deform the wrapper barrel 72 during assembly, as will soon be described more fully.

Determination of preload can be based upon the full power pressure and temperature operating requirements (magnitude and rate by which they are achieved or "ramped") of any steam generator. Therefore, the amount of preload is generally unit or site specific, being dependent upon actual full power operating conditions of a particular steam generator. That is, when fine tuning is performed, there are certain site dependent details that cannot be discarded, for example, specific thermal-hydraulic performance and operating requirements of a particular steam generator model or site and/or specific earthquake spectra of the intended geographic area.

Factors included in the determination of preload include: the mechanical properties of the wrapper barrel material; the amount of stud 80 torque generally required to deform the wrapper barrel 72 a desired distance; the design and geometry of the connection assembly; the coefficients of thermal expansion of the tube support plates 74 and the wrapper barrel 72; full operating temperature and pressure of the steam generator internals; transient operation, including temperature and pressure of the steam generator internals; and the particular earthquake spectra of the site upon which the steam generator will be installed. The resulting preload value represents the amount of deformation which will be effected in the wrapper barrel 72 during unit structuring through increased torque on the studs 80.

For example, the amount of preload required for an Incoloy 800 Class tube support plate 74 in assignee's pressurized water reactor steam generator design is on the order of 100 mill (0.100 inch). This preload is ensured during assembly by controlling stud 80 torque and by radially measuring (at circumferential opposing locations) at each tube support plate 74 elevation the distance between the tube support plate 74 and the wrapper barrel 72 where a jacking assembly 76 is located, as will be described more fully hereafter.

More particularly, FIGS. 3–6 represent: (I) how to effect preload during assembly of a nuclear steam generator according to the present invention; and (II) the four phenomena occurring simultaneously during heat-up and operation of the steam generator and the unique configuration thus resulting from the preload. Those four phenomena are: (A) expansion of the outer shell 78 due to thermal difference and pressure dilation; (B) relief of the preload when the outer shell 78 expands; (C) expansion of the wrapper barrel 72 due to its normal thermal growth; and (D) expansion of the tube support plates 74 because of their normal thermal growth.

Figure 3:
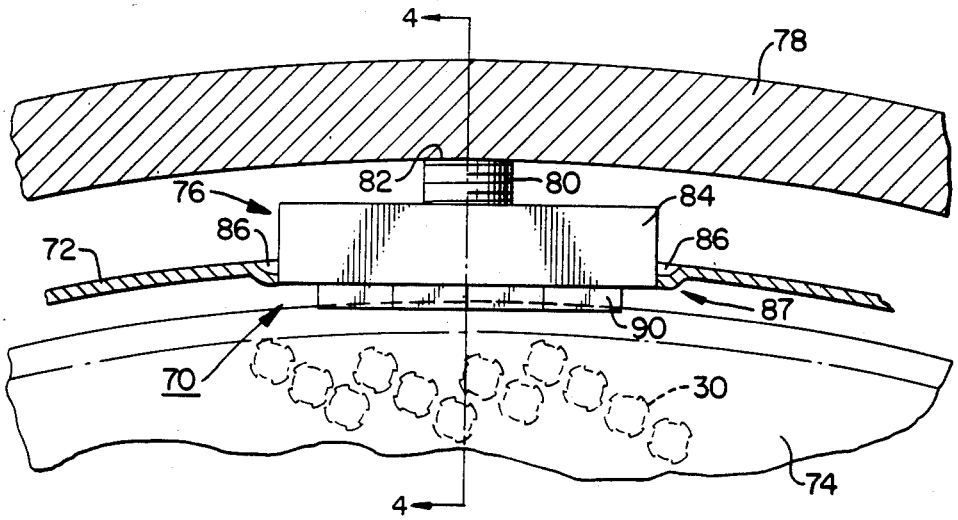
FIG. 3 is a top, cross-sectional view of the wrapper barrel/tube support plate connection assembly according to the present invention after assembly, but before operation of the steam generator.
Figure 2B:
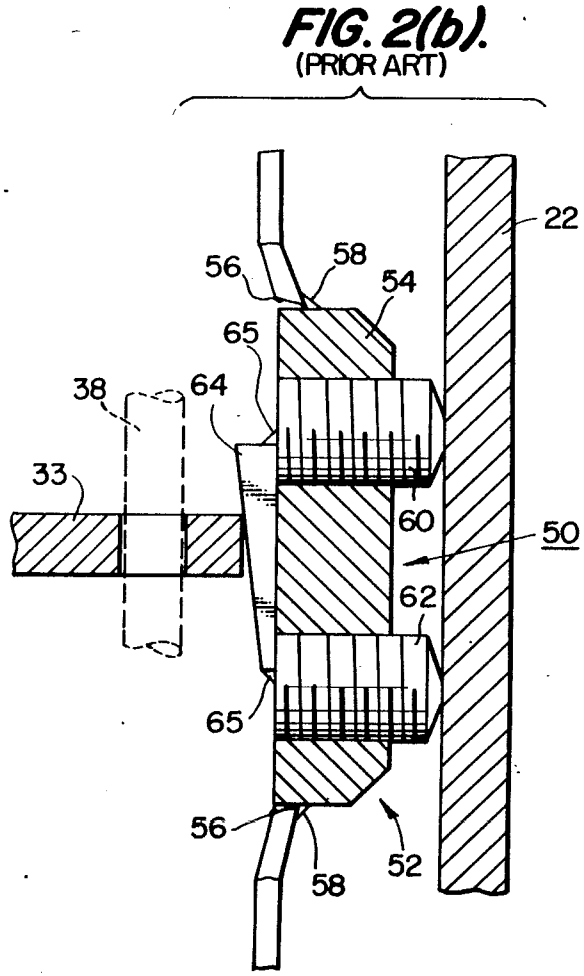
FIG. 2(b). (PRIOR ART)
Figure 2A:
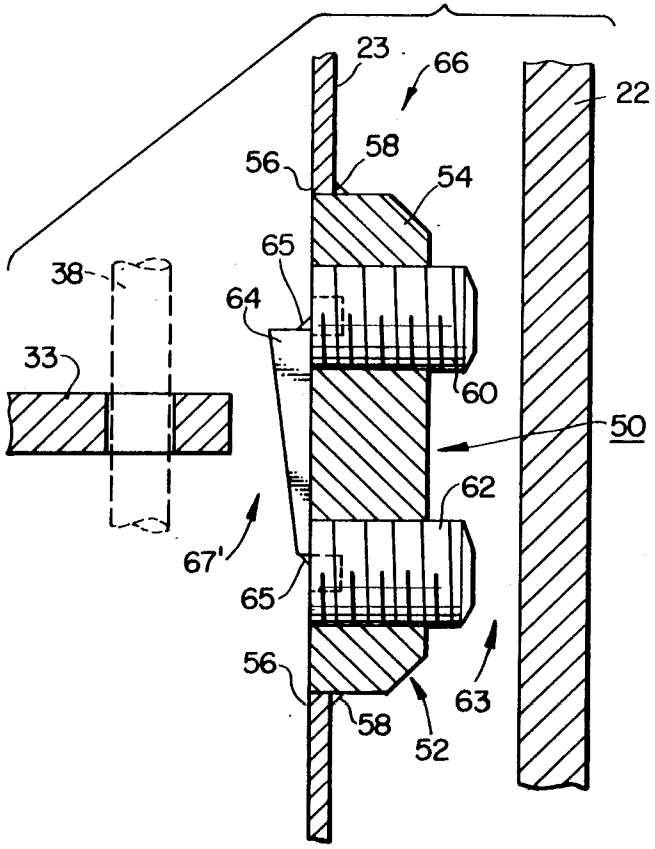
FIG. 2(a). (PRIOR ART)
Figure 4:
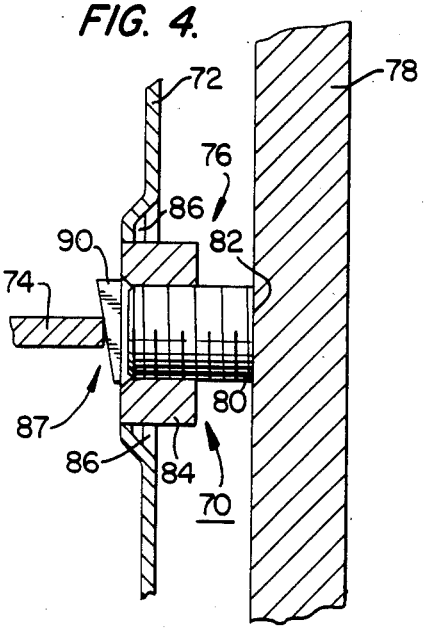
FIG. 4 is a side, cross-sectional view of the wrapper barrel/tube support plate connection assembly according to the present invention shown in FIG. 3.

The method for effecting preload will now be discussed with particular reference to FIGS. 3 and 4.

(I) Preload

The present invention is intended to create a preload in a wrapper barrel 72 having a first coefficient of thermal expansion used in combination with a tube support plate 74 having a second, relatively higher coefficient of thermal expansion.

The following series of steps are required to ensure proper preload during assembly of the steam generator:

1. Initially determine the approximate preload required using the factors discussed above;
2. Measure the outer shell 78 internal diameter at each intended tube support plate 74 location;
3. Measure the wrapper barrel internal diameter at each intended tube support plate location;
4. Measure and determine the jacking stud 80 length required to center the wrapper barrel 72 relative to the outer shell 78;
5. Insert the wrapper barrel 72 into the outer shell 78. In order to ensure that the radial deformation of the wrapper barrel 72 required at preload is not compromised by the weight-induced (dead weight) deflection of the outer shell 78 itself, a steam generator employing this invention should be vertically assembled, rather than the conventional horizontal assembly;
6. Insert the studs 80 into the jacking blocks 84;
7. Center the wrapper barrel 72 in the outer shell 78 by installing all studs 80 and tightening each stud 80 to the predetermined and/or premeasured centering distance while the wrapper barrel 72 is supported by a crane or hoist mechanism;
8. Measure the diameters across the plate of diametrically opposite jacking blocks 84 after centering the wrapper barrel 72 in the outer shell and having the studs 80 in light contact with the outer shell 78;
9. Turn and torque the studs 80 that portion of a turn required for appropriate thread engagement and preload, while remeasuring the wrapper barrel inner diametrical distances between opposite jacking blocks 84 in a predetermined sequence.

The method may also require the following additional step. Tube support plates are usually alphabetically ordered from the bottom to the top of the steam generator. In the particular steam generator in which the present invention is intended to be employed, there are six tube support plates A-F and a "G"-plate occurring in the top or cone region. Some steam generators differ in that they do not use a plate in the cone region or they include more than six plates in the straight cylindrical region, due to the overall design of the steam generator and the height of the tube bundle 40. If a "G"-plate or any plate(s) is/are used in the cone region, the geometry of the corresponding jacking blocks or other suitable connection assembly means for the cone region has to correspond to the contour of the cone region, which is in contrast to a straight section of the wrapper barrel where straight jacking blocks are used. Accordingly, effecting preload at the "G"-plate in the transition cone may require particular deflection measuring to effect preload thereat.

Again, referring to FIGS. 3 and 4, turning the studs 80 the portion of turn requied for preload, as described in substep (9), induces local wrapper barrel 72 deformation 86 while maintaining an adequate peripheral gap 87 between the wrapper barrel 72 and each tube support plate 74.

That is, since the steam generator outer shell 78 is made stronger, stiffer and thicker (e.g., three inches) than the wrapper barrel 72, (e.g., $\frac{3}{8}$ of an inch), as the head 82 of each stud 80 in the jacking assembly 76 is caused to bear against the outer shell 78, a local deformation 86 is introduced into the wrapper barrel 72.

The gap 87 is usually filled with spacer means 90. Each spacer means 90 is about 2 inches long and preferably 4 spacer means (adjacent circumferentially) are used between the jacking assembly 76 and the tube support plate 74. The particular shape of the spacer means 90 is determined by how tightly one wants to control the fit at assembly and what the thickness and, hence, bearing area of the support plate is. A wedge shape is preferred because it provides a margin of error when positioning the tube support plate 74, i.e., it acts as a variable gap filler and is much easier to assemble with the overall space limitations and manufacturing process constraints.

(II) Four Phenomena During Operation

The four phenomena occurring during heat-up and operation, which were introduced above, will now be described in reference to FIGS. 5 and 6.

(A) Outer Shell Expansion

After assembly of the steam generator is completed and preload is effected in the wrapper barrel 72, the steam generator is ready for heat-up and full operation.

Figure 5:
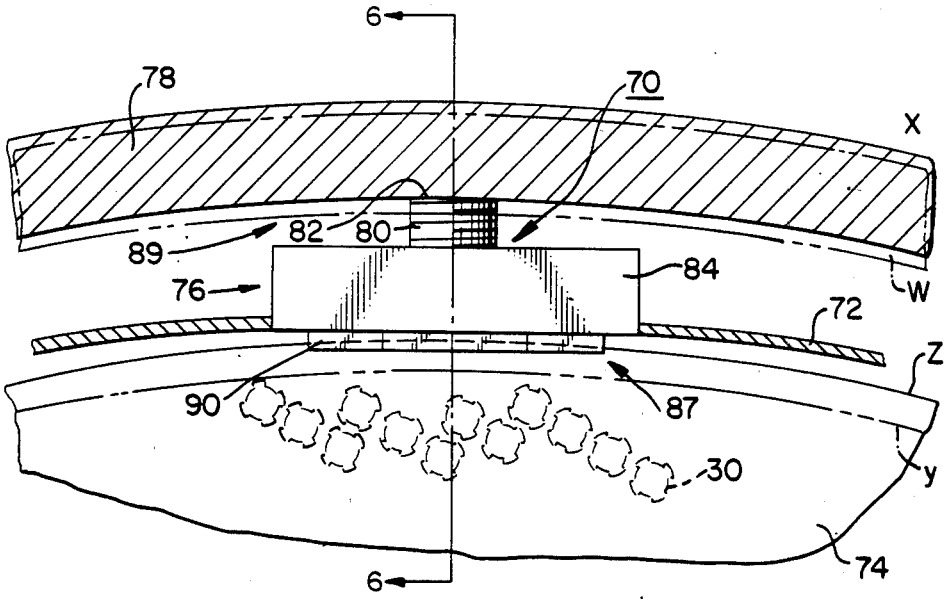
FIG. 5 is a top, cross-sectional view of the wrapper barrel/tube support plate connection assembly according to the present invention during operation.
Figure 6:
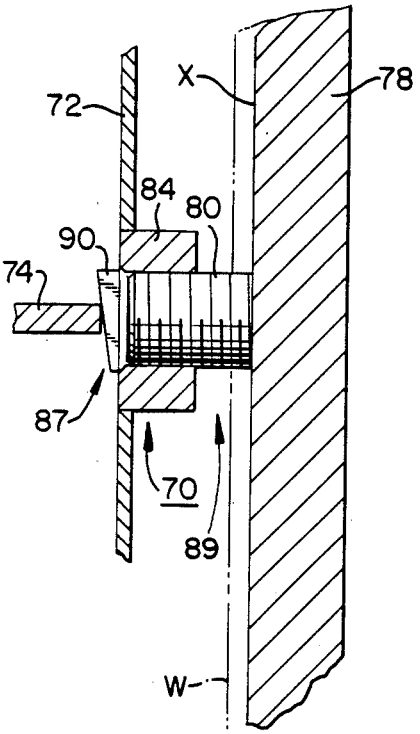
FIG. 6 is a side, cross-sectional view of the wrapper barrel/tube support plate connection assembly shown in FIG. 5.

As shown in FIGS. 5 and 6, when the steam generator is pressurized and heats-up during operation, the outer shell 78 moves from location "W", to location "X". More particularly, pressurizing the steam generator causes the outer shell 78 to expand, as would any vessel under pressure. That is, the outer shell 78, being approximately 3 inches thick, is designed to withstand all expected expansion and pressure stresses during operation. In addition, the shell grows radially due to the thermal characteristics of the steam generator. Thus, when there is a pressure and a thermal difference between the outside atmosphere and the inside of the outer shell 78, the outer shell 78 expands to reach equilibrium.

(B) Relief of Preload

As soon as the outer shell 78 expands, it offers the abutting stud 80 an opportunity to relieve the wrapper barrel 72 preload. Thus, as soon as the outer shell 78 expands (keeping in mind that each stud head 82 is initially bearing against the outer shell 78), the movement of the outer shell 78 tends to relieve each stud 80 and connected jacking block 84 of the jacking assembly 76 with it. Since each jacking block 84 is welded to the wrapper barrel 72 as described above, movement of the shell and the load relief on the jacking stud and the jacking block 84 also results in the corresponding outward deformation or restoration of the wrapper barrel 72 cylindrically to a uniform radius at all locations. The original elastic deformation 86 is then eliminated. Accordingly, preload of the wrapper barrel 72 is relieved. The gap 87 between the tube support plate 74 and the wrapper barrel 72 correspondingly increases after the wrapper barrel 72 elastically springs out.

(C) Wrapper Barrel Expansion

During operation, the heat of the steam generator also causes the wrapper barrel 72 to, thermally grow and, hence, expand according to its coefficient of expansion, further increasing the gap 87. The size of the gap 87 at this time corresponds to the preload originally effected in the wrapper barrel 72.

(D) Tube Support Plate Expansion

During operation, the tube support plate 74 also expands according to its coefficient of thermal expansion. That is, since the coefficient of thermal expansion of the tube support plate 74 is far greater than any of the other members discussed above, the tube support plate 74 thermally grows and, hence, expands more radially during operation than the other members due to thermal growth and will catch up, i.e., the tube support plate 78 will close the gap 87 between itself and the expanded wrapper barrel 72. This expansion is represented by the change in location of the outer edge of the tube support plate 74 from location "Y" to location "Z" shown in FIG. 5.

The result is an elimination of any thermal interference which might have occurred between the tube support plate 74 and the wrapper barrel 72. Accordingly, the mechanical loads of the steam generator are significantly reduced and any dynamic loading is shifted to the jacking stud 80/outer shell 78 interface which can be more efficiently addressed by the design of the thick-walled member.

Overall, radial tuning of the wrapper barrel 72 according to the amount of preload required for any particular set of conditions characteristic of a particular steam generator results in a tight fit of the above-described members throughout assembly and operation.

EXAMPLE

The following example, considering an 80 mill (0.080 inch) preload has been determined, illustrates the four phenomena (A)–(D), described above. Again, FIGS. 5 and 6 are referred to.

During heat-up of the steam generator, the outer shell 78 expands 310 mill (0.310 inch) due to the pressure differential between the inside and outside of the outer shell 78 and due to heat expansion. That is, 260 mill (0.260 inch) of the expansion is due to thermal effects and 50 mill (0.050 inch) of the expansion is due to pressure effects. The result is that a 310 mill (0.310 inch) gap 89 is formed between the head 82 of the stud 80 and the inner wall of the outer shell 78.

After the outer shell 78 expands, preload of the wrapper barrel 72 can be relieved via the stud 80. More particularly, as soon as the outer shell 78 expands, the stud 80 which was initially bearing tight against the outer shell 78 now has the opportunity to relieve the preload. Consequently, the jacking block 84 also has an opportunity to relieve the preload and the connected wrapper barrel 72 is caused to elastically reform and expand 80 mill (0.080 inch). The result is that the gap 89 between the head 82 of the stud 80 and the outer shell 78 is reduced to 230 mill (0.230 inch). However, this movement also results in a wrapper barrel 72/tube support plate 74 gap 87 of 80 mill (0.080 inch). This distance corresponds to the preload originally effected in the wrapper barrel 72.

Next, one looks at the movement of the wrapper barrel 72 itself. Since the wrapper barrel 72 is made of carbon steel, it must also expand under thermal input. In this example, the expansion amounts to 230 mill (0.230 inch). Since the stud 80 and the jacking block 84 are welded and essentially fixed to the wrapper barrel 72, they must translate in space exactly the distance the wrapper barrel 72 has translated in space. Accordingly, each jacking assembly 76 is correspondingly radially displaced 230 mill (0.230 inch). The total gap 89 between the outer shell 78 and the stud 80 is then reduced to 0 mill, which is desirable for dynamic analysis purposes because this gap is critical for seismic conditions. The resulting totals at this stage are: (a) the gap 89 between the outer shell 78 and the head 82 of the stud 80 is 0 mill (0.0 inch) (i.e., 230 mill minus 230 mill); and (b) the gap 87 between the wrapper barrel 72 and the tube support plate 74 is 310 mill (i.e., 80 mill plus 230 mill).

Next, the tube support plate 74 also thermally grows or expands due to thermal input or heat transfer occuring with the steam generator internals at operational temperature. The tube support plate 74 expands by a sufficient radial distance required to appreciably close the gap 87 between it and the wrapper barrel 72. That is, the tube support plate 74 expands 277 mill (0.277 inch) under thermal input. The results are: (a) the gap 87 between the tube support plate 74 and the wrapper barrel 72 is reduced by 277 mill (0.277 inch) leaving a gap 87 of 33 mill (0.033 inch) (i.e., 310 mill minus 277 mill); and (b) the gap 89 between the outer shell 78 and the head 82 of the stud 80 remains unchanged at 0 mill, which is advantageous because little or no gap is desired at this interface, as stated above. Accordingly, a 23 mill gap 87 now exists between the tube support plate 72 and the spacer means 90. The outer shell 78 to stud 80 head 82 gap 89 remains unchanged at 0 mill.

Thus, the assembly 70 started with a tight fit, i.e., an outer shell 78 to stud 80 gap 87 of 0 mill and ended up with a tight fit, i.e., an outer shell 78 to stud 80 gap 87 of 0 mill. However, a small gap 87 exists between the tube support plate 74 and each spacer means 90, which gap is desired in order to provide a design margin to prevent the tube support plate 78 from crashing or knocking against the wrapper barrel 72 during transient excursions.

Accordingly, the present invention allows for control of the magnitude of the two gaps 87 and 89 in the wrapper barrel/tube support plate connection assembly 70 and the preload depends upon the gaps 87 and 89 chosen for a specific site, e.g., based on earthquake characteristics of the site.

Notably, the resultant total gap 87 between the tube support plate 74 and wrapper barrel 72 can be controlled to be less than that for a conventional steam generator. That is, it is desired that the gap 87 be small enough so that load is not increased on the tube support plates 74 nor on the wrapper barrel, a structurally thin member relative to the shell. If the gap 87 were to be very large, seismic effects could damage the steam generator. If the gap 87 were to be very small, the tube support plates 74 could crash into the wrapper barrel 72. A gap 87 somewhere in the middle is desired. By properly choosing the preload according to the present invention, a proper gap 87 can be achieved.

In addition, it is not desired that the outer shell 78 and the stud 80 have an interference because these studs 80 are very thick bolts and during operation it is desirable that they should not be knocking against the outer shell 78. The present invention can minimize or, preferably, eliminate this gap 89. The present invention can create either a tight fit or a very small gap 89 between the outer shell 78 and each stud 80, as desired.

An additional feature is also provided by the present invention to further control and limit the amount of radial interference which may occur at operating temperatures. That is, the gap 87 remaining between the tube support plate 74 and the wrapper barrel 72 after introduction of the preload is tightly fit with a novel spacer means 90. As shown in FIGS. 7–10, the spacer means 90 of the present invention includes several alternate embodiments.

Figure 7:
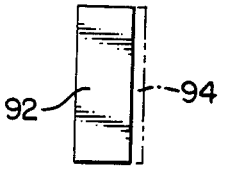
FIG. 7 is a side, cross-sectional view of one embodiment of a spacer means according to the present invention, illustrating particularly a heat and/or pressure dissolvable, organic, high strength, polymer material applied to a surface of a rectangular shim.
Figure 8:
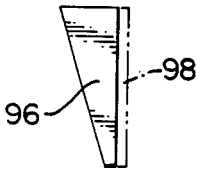
FIG. 8 is a side, cross-sectional view of another embodiment of the spacer means according to the present invention, illustrating particularly a heat and/or pressure dissolvable, organic, high strength, polymer material applied to a surface of a wedge.

For example, FIGS. 7 and 8 illustrate a metallic, rectangular shim 92 and wedge 96, respectively, with a predetermined amount of heat and/or pressure dissolvable, organic, high strength, polymer material 94 and 98, respectively, on a surface of each.

As suggested, the organic material would have to be heat and/or pressure dissolvable. That is, as the steam generator begins operating, the internal pressure and/or temperature accelerates dissolution of the organic material.

The organic material's constituents would also have to be compatible with the chemistry requirements of the inside of the steam generator. Generally hydrocarbons are preferred, as long as consideration is given to preventing excessive amounts of undesirable trace elements (such as lead or sulphur) in the hydrocarbons. The dissolvable organic material, in any case, is of relatively negligible volume as compared to the secondary fluid system volume and, therefore, no chemical interference with the secondary side fluid would be anticipated. As a matter of fact, dissolvable organic members have already been used in steam generators, but only to help insert tubes into the tubesheet. So there is precedence for the organic material and its trace elements being acceptable in a steam generator.

The additional volume residue left by dissolution of said material when configured into the size and number of structural elements described above would be within specification limits for nuclear steam generators established by prior testing. The tensile and compression properties of this organic material are sufficient to satisfy the structural and functional requirements of the spacer means 90.

The dissolvable spacer means 90 maintains a tight fit between the tube support plate 74 and the wrapper barrel 72 during assembly and before operation, as do the wedges 64 (FIG. 2) of the prior art. An additional cold gap fit tolerance of (40–60 mill) accommodates the dissolvable spacer means 90 and further accommodates the tube support plate 74 thermal expansion/radial growth.

The dissolvable spacer means 90 is also intended to sustain lateral loadings incurred during heat-up and operation of the steam generator. More particularly, the spacer means 90 having the organic material surface dissolves or deconstitutes itself as the temperature and/or pressure increases to that corresponding to full power. The resultant radial gap 87 between the wrapper barrel 72 and the tube support plate 74 will then be accommodated by the normal expansion of the tube support plate 74.

In still another embodiment of the present invention, the entire spacer means 90 or any part thereof could be made of a dissolvable organic material. Accordingly, if the temperature and/or pressure got to be such that the entire wedge dissolved, optimum tube support plate 74 orientation would be provided. This is so because it is not desired to have the edge of the tube support plate 74 crash into the jacking block 84 of the wrapper barrel 72. An internal gap between the edge of the tube support plate 74 or its periphery and the inside diameter of the wrapper barrel 72 is acceptable during full power operation, since the dead and live loads of the tube support plate 74 itself can easily be supported by selectively distributed vertical supporting and span preserving vibration/structural elements called "stay rods" (not shown). These stay rods are supported by welding and are threaded into the tubesheet, the top tube support plate and full length through all other tube support plates at selected locations.

These spacer means 90 are only important for assembly; they are not used for structural reasons during operation. As a matter of fact, it is desired to have the spacer means 90 disappear during operation. The benefit of an entirely organic spacer means 90 is that it disappears. Accordingly, one can reduce the likelihood that the tube support plate 74 will crash into the wrapper barrel 72 by increasing the gap 87 between these two structures.

Figure 9:
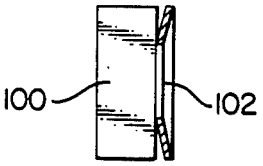
FIG. 9 is a side, cross-sectional view of another embodiment of the spacer means according to the present invention, illustrating particularly a belleville spring washer attached to a surface of a rectangular shim.
Figure 10:
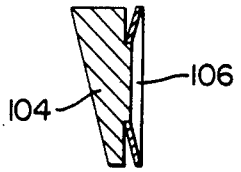
FIG. 10 is a side, cross-sectional view of another embodiment of the spacer means according to the present invention, illustrating particularly a belleville spring washer attached to a surface of a wedge.

FIGS. 9 and 10 illustrate, respectively, a metallic, rectangular shim 100 and a wedge 104 having a deflection-controlled, bellevelle spring 102 and 106, respectively, attached to a surface of each.

The spring-surfaced spacer means 90 maintains a tight fit between the tube support plate 74 and the wrapper barrel 72 during assembly and before operation, as do the wedges 64 (FIG. 2) of the prior art. The spacer means 90 having the spring surface is also intended to sustain lateral loadings incurred during heat-up of the steam generator. This embodiment of the spacer means 90 is biased by the expanding tube support plate 74 as the temperature and/or pressure is increased to full power.

Thus, the present invention reduces jacking stud head 82 to outer shell 78 gap 89, lowers dynamic loading and mitigates increases in required tube support plate 74 thickness. In addition, the present invention restores the gap 87 at the tube support plate 74/wrapper barrel 72 interface, thus eliminating thermal expansion concerns. Resultantly, this invention permits the use of a highly corrosion resistant tube support plate material to be used in a conventionally designed nuclear steam generator despite its mechanically adverse coefficient of thermal expansion.

The foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the scope of the invention and the appended claims and their equivalents.

I claim as my invention:

1. A method for assembling a plurality of wrapper barrel/tube support plate connection assembies, each including a jacking assembly with a jacking block and a jacking stud, into a steam generator outer shell, comprising the steps of:

(a) determining an approximate preload value based on the full operational temperature and pressure characteristics of the steam generator;

(b) measuring the internal diameter of the outer shell at each intended tube support plate location;

(c) measure the wrapper barrel internal diameter at each intended tube support plate location;

(d) measuring and determining the length of each of the jacking studs required to center the wrapper barrel relative to the outer shell;

(e) inserting the wrapper barrel vertically into the outer shell;

(f) inserting each jacking stud into each jacking block;

(g) centering the wrapper barrel in the outer shell by installing and tightening each jacking stud to the predetermined centering distance while supporting the wrapper barrel;

(h) measuring the diameter across the plate between each pair of diametrically opposite jacking blocks after centering the wrapper barrel in the outer shell and having each stud in light contact with the outer shell; and (i) turning and torquing each stud that portion of the turn required for appropriate thread engagement and by the predetermined preload while remeasuring the wrapper barrel inner diametrical distances between opposing jacking blocks in sequence.

2. The method as recited in claim 2, further comprising the step of:

(i) inserting spacer means for accommodating thermal growth of the tube support plate between each tube support plate and the wrapper barrel at each jacking assembly location.

3. The method as recited in claim 2, wherein the spacer means comprises:

a heat-dissolvable, organic shim.

4. The method as recited in claim 2, wherein the spacer means comprises:

a pressure-dissolvable, organic shim.

5. The method as recited in claim 2, wherein the spacer means comprises:

a heat-dissolvable, organic wedge.

6. The method as recited in claim 2, wherein the spacer means comprises:

a pressure-dissolvable, organic wedge.

7. The method as recited in claim 2, wherein the spacer means comprises:

a metal shim having a heat-dissolvable, organic surface thereon.

8. The method as recited in claim 2, wherein the spacer means comprises:

a metal shim having a pressure-dissolvable, organic surface thereon.

9. The method as recited in claim 2, wherein the spacer means comprises:

a metal wedge having a heat-dissolvable, organic surface thereon.

10. The method as recited in claim 2, wherein the spacer means comprises:

a metal wedge having a pressure-dissolvable, organic surface thereon.

11. The method as recited in claim 2, wherein the spacer means comprises:

a metal shim having a belleville spring washer attached to a surface thereof.

12. The method as recited in claim 2, wherein the spacer means comprises:

a metal wedge having a belleville spring washer attached to a surface thereof.

13. A steam generator wrapper barrel/tube support plate connection assembly, comprising:

(a) a generally cylindrical outer shell having a first diameter;

(b) a wrapper barrel having a second, relatively smaller diameter so as to fit within the outer shell with an annular space therebetween, and being made of a material having a first coefficient of thermal expansion;

(c) a plurality of vertically spaced tube support plates located within the wrapper barrel, each being made of a material having a second, relatively higher coefficient of thermal expansion; and (d) adjustable jacking assembly means positioned between the wrapper barrel and the outer shell, for effecting a preload in the wrapper barrel such that a deformation is caused in the wrapper barrel at the adjustable jacking assembly means.

14. The assembly as recited in claim 13, further comprising:

(e) spacer means for accommodating thermal growth of the tube support plate inserted between the tube support plate and the wrapper barrel at the adjustable jacking assembly means.

15. The assembly as recited in claim 14, wherein the spacer means comprises:

a heat-dissolvable, organic shim.

16. The assembly as recited in claim 14, wherein the spacer means comprises:

a pressure-dissolvable, organic shim.

17. The assembly as recited in claim 14, wherein the spacer means comprises:

a heat-dissolvable, organic wedge.

18. The assembly as recited in claim 14, wherein the spacer means comprises:

a pressure-dissolvable, organic wedge.

19. The assembly as recited in claim 14, wherein the spacer means comprises:

a metal shim having a heat-dissolvable, organic surface thereon.

20. The assembly as recited in claim 14, wherein the spacer means comprises:

a metal shim having a pressure-dissolvable, organic surface thereon.

21. The assembly as recited in claim 14, wherein the spacer means comprises:

a metal wedge having a heat-dissolvable, organic surface thereon.

22. The assembly as recited in claim 14, wherein the spacer means comprises:

a metal wedge having a pressure-dissolvable, organic surface thereon.

23. The assembly as recited in claim 14, wherein the spacer means comprises:

a metal shim having a belleville spring washer attached to a surface thereof.

24. The assembly as recited in claim 14, wherein the spacer means comprises:

a metal wedge having a belleville spring washer attached to a surface thereof.

* * * * *